US010603244B2

(12) United States Patent
Dupourque

(10) Patent No.: US 10,603,244 B2
(45) Date of Patent: Mar. 31, 2020

(54) MOBILE ASSISTANCE ROBOT COMPRISING AT LEAST ONE PIVOTING BEARING SYSTEM

(71) Applicant: KOMPAÏ ROBOTICS, Bidart (FR)

(72) Inventor: Vincent Dupourque, Anglet (FR)

(73) Assignee: KOMPAÏ ROBOTICS, Bidart (FR)

( * ) Notice: Subject to any disclaimer, the term of this patent is extended or adjusted under 35 U.S.C. 154(b) by 0 days.

(21) Appl. No.: 16/337,671

(22) PCT Filed: Sep. 27, 2017

(86) PCT No.: PCT/FR2017/052601
§ 371 (c)(1),
(2) Date: Mar. 28, 2019

(87) PCT Pub. No.: WO2018/060597
PCT Pub. Date: Apr. 5, 2018

(65) Prior Publication Data

US 2019/0269572 A1 Sep. 5, 2019

(30) Foreign Application Priority Data

Sep. 29, 2016 (FR) ..... 16 59321

(51) Int. Cl.
*A61H 3/04* (2006.01)

(52) U.S. Cl.
CPC ..... *A61H 3/04* (2013.01); *A61H 2003/043* (2013.01); *A61H 2201/12* (2013.01);
(Continued)

(58) Field of Classification Search
CPC ..... A61H 3/04; A61H 2003/043
See application file for complete search history.

(56) References Cited

U.S. PATENT DOCUMENTS 9,186,992 B2 * 11/2015 Katayama ..... B62D 51/04
10,307,321 B2 * 6/2019 Pan ..... A61G 5/08
(Continued)

FOREIGN PATENT DOCUMENTS

DE 10 2008 049035 4/2010
DE 20 2012 007865 8/2012
(Continued)

OTHER PUBLICATIONS

International Search Report, PCT/FR2017/052601, dated Jan. 3, 2018.

*Primary Examiner* — John D Walters
*Assistant Examiner* — James J Triggs
(74) *Attorney, Agent, or Firm* — Young & Thompson

(57) ABSTRACT

Disclosed is a mobile robot which includes: a mobile base which exhibits a control system configured to control the characteristics of the motion of the mobile base; and a bearing system configured to be grasped by a person. The bearing system is configured to pivot freely with respect to the mobile base about a vertical rotation axis. The robot includes at least one first sensor configured to detect at least one characteristic of a rotation motion of the bearing system with respect to the mobile base and to advise the control system which is configured to modify the trajectory of the robot as a function of the characteristic, detected by the first sensor, of the rotation motion of the bearing system.

20 Claims, 3 Drawing Sheets

(52) U.S. Cl.
CPC ..... *A61H 2201/1215* (2013.01); *A61H 2201/1223* (2013.01); *A61H 2201/5007* (2013.01); *A61H 2201/5025* (2013.01); *A61H 2201/5038* (2013.01); *A61H 2201/5043* (2013.01); *A61H 2201/5069* (2013.01); *A61H 2201/5079* (2013.01)

(56) References Cited

U.S. PATENT DOCUMENTS

| | | | | |
|---|---|---|---|---|
| 10,343,703 | B2 * | 7/2019 | Andersson | B60L 3/08 |
| 2014/0358344 | A1 * | 12/2014 | Katayama | A61H 3/04 701/22 |
| 2015/0060175 | A1 | 3/2015 | Katayama | |

FOREIGN PATENT DOCUMENTS

| | | |
|---|---|---|
| FR | 2 796 548 | 1/2001 |
| WO | WO 2008/062408 | 5/2008 |
| WO | WO 2015/053244 | 4/2015 |
| WO | WO 2018-148018 | 8/2018 |

* cited by examiner

MOBILE ASSISTANCE ROBOT COMPRISING AT LEAST ONE PIVOTING BEARING SYSTEM

This application relates to a mobile assistance robot comprising at least one pivoting bearing system.

The document WO-2008/149018 describes a versatile robot specifically designed for the assistance of an individual. This robot comprises a mobile base that has in its lower part wheels and a control system comprising power units, sensors and controls that make it possible to control the movements of the mobile base. The versatile robot described in this document WO-2008/149018 is thus fully capable of moving in a home environment, for example.

Figure 8:
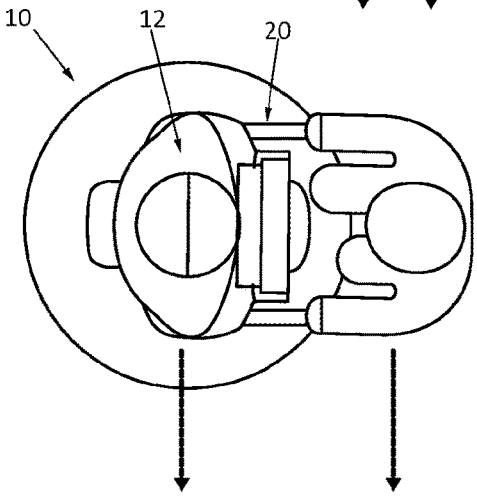

According to an embodiment described in FIG. 8, the robot is specifically designed for the assistance of an individual, and it can be equipped with accessories. According to this document, the versatile robot can pull a walking device that comprises a rolling base harnessed to the versatile robot. In this case, the robot follows a path that it has determined, and the individual supported on the walking device follows the path imposed by the robot. In certain circumstances, for example when the robot follows a curved path, the path followed by the robot and imposed on the individual is not always the ideal path for the individual. Inasmuch as the ideal path varies from one individual to the next, it is difficult to configure the control system so that the paths of each robot are suitable for the paths of each individual.

This invention aims to eliminate the drawbacks of the prior art.

For this purpose, the invention has as its object a mobile robot comprising:

- a mobile base that has a control system configured to control the characteristics of the movement of the mobile base,
- a bearing system configured to be grasped by an individual, characterized in that the bearing system is configured to pivot freely relative to the mobile base about a vertical axis of rotation and in that the robot comprises at least a first sensor configured to detect at least one characteristic of a movement of rotation of the bearing system relative to the mobile base and to inform the control system that is configured to modify the path of the robot as a function of the characteristic of the movement of rotation of the bearing system that is detected by the first sensor.

Thus, the individual can choose a path independent of that of the mobile base and can impose a path on the mobile base.

Figure 1:
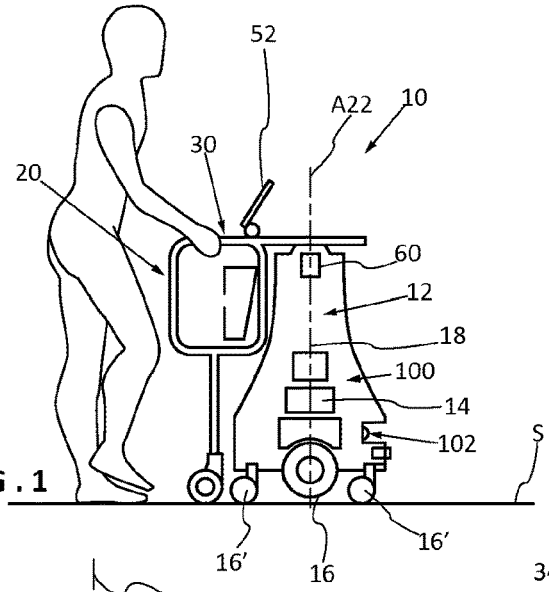
Figure 2:
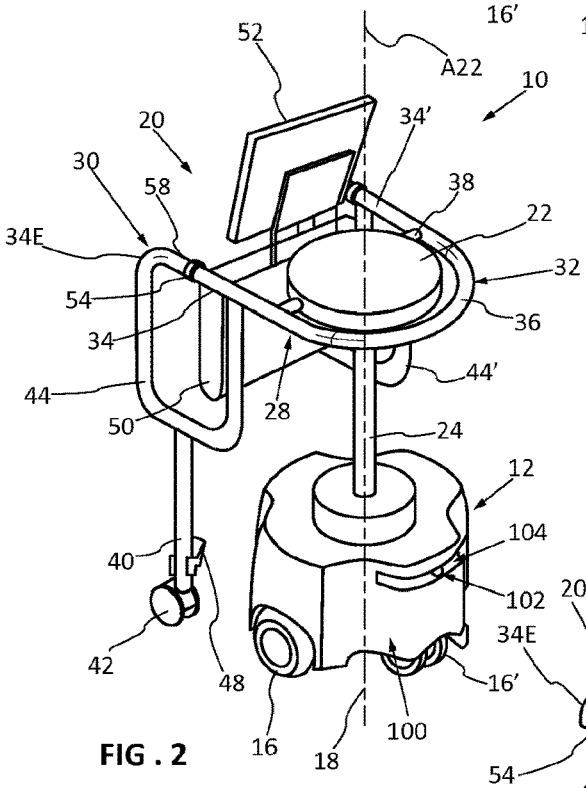
Figure 3:
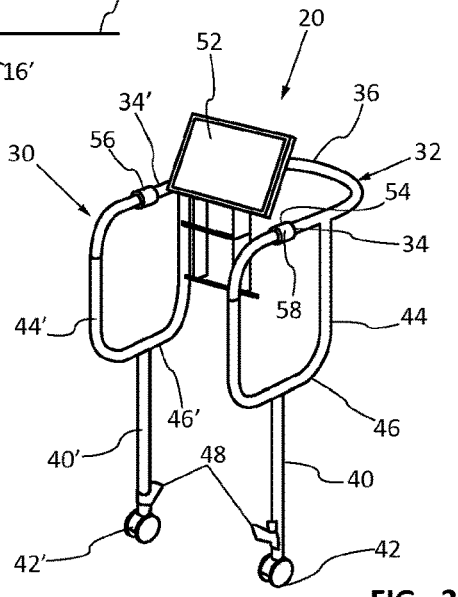
Figure 4:
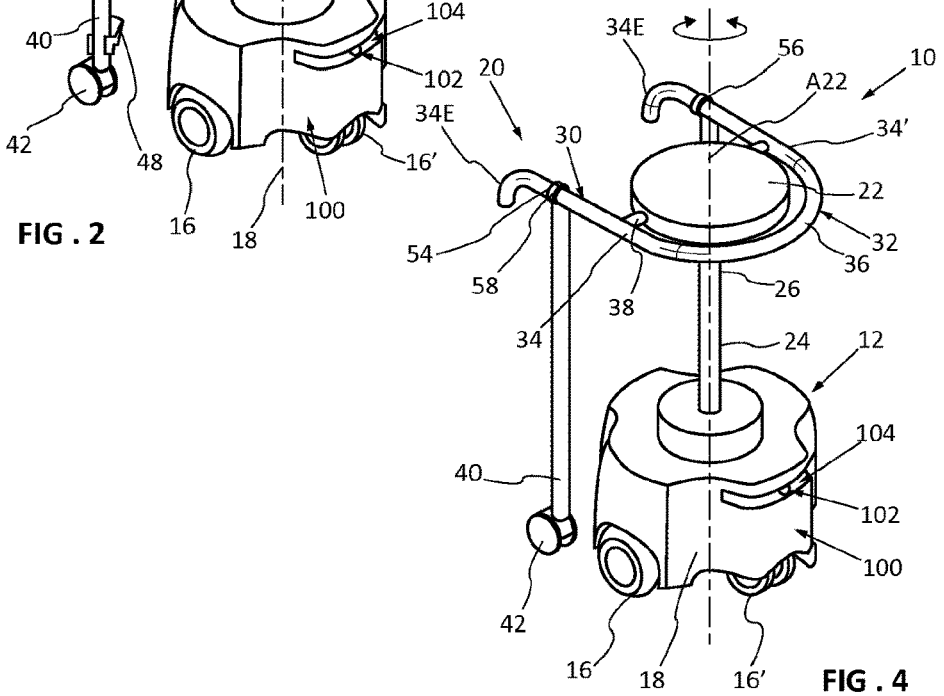
Figure 5A:
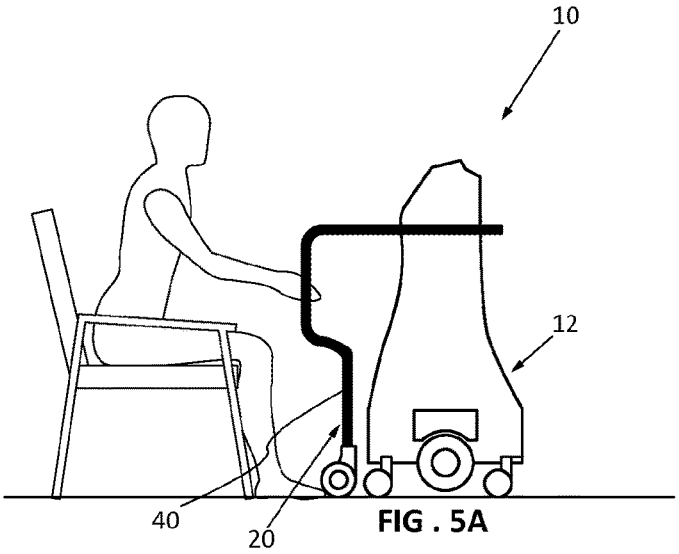
Figure 5B:
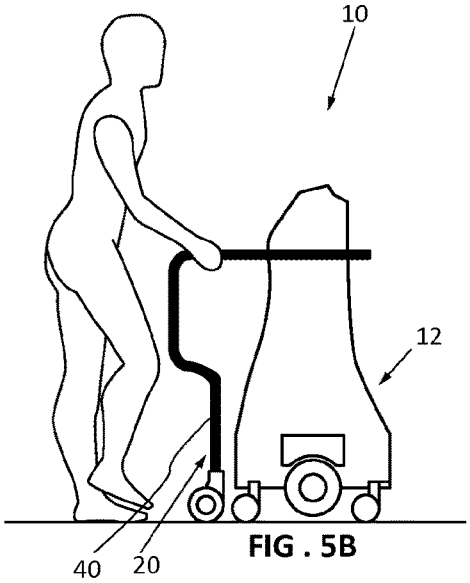
Figure 6:
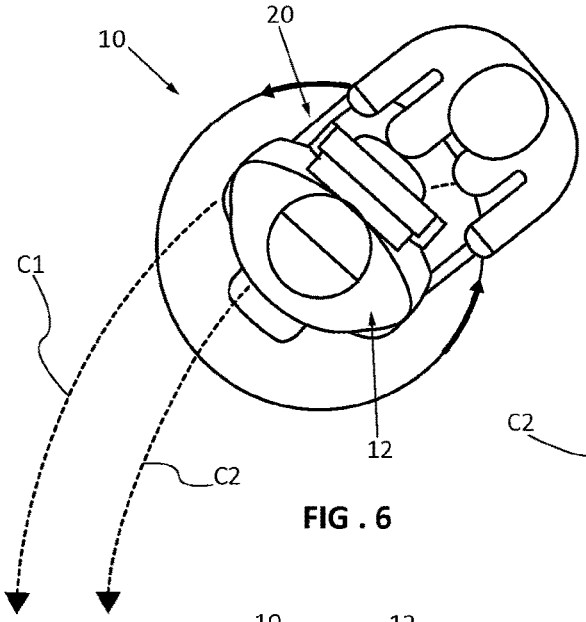
Figure 7:
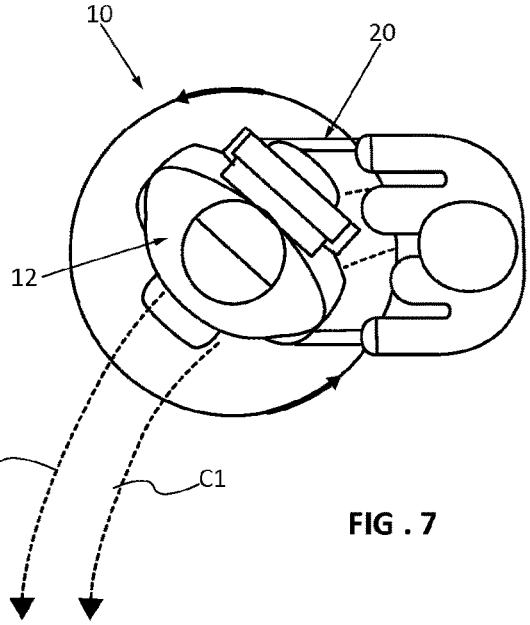
Figure 9:
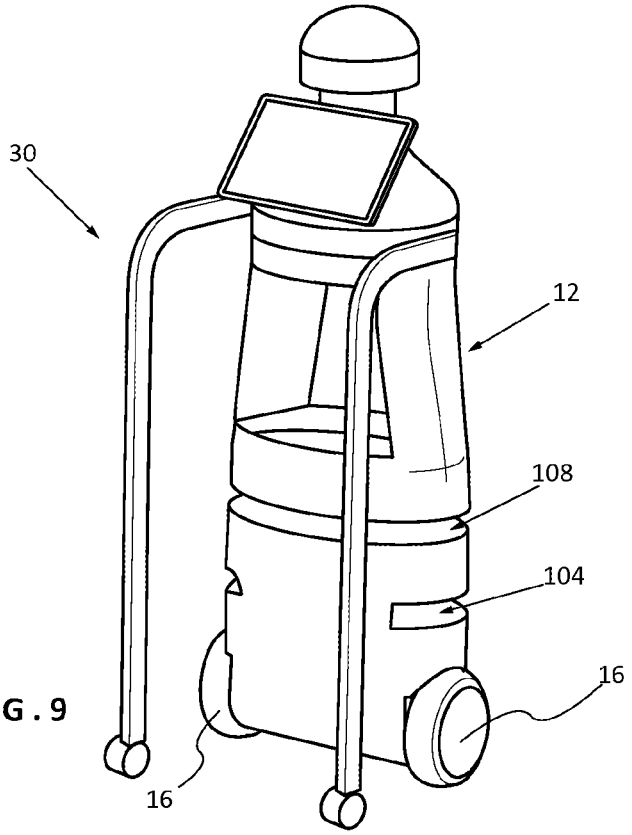
Figure 10:
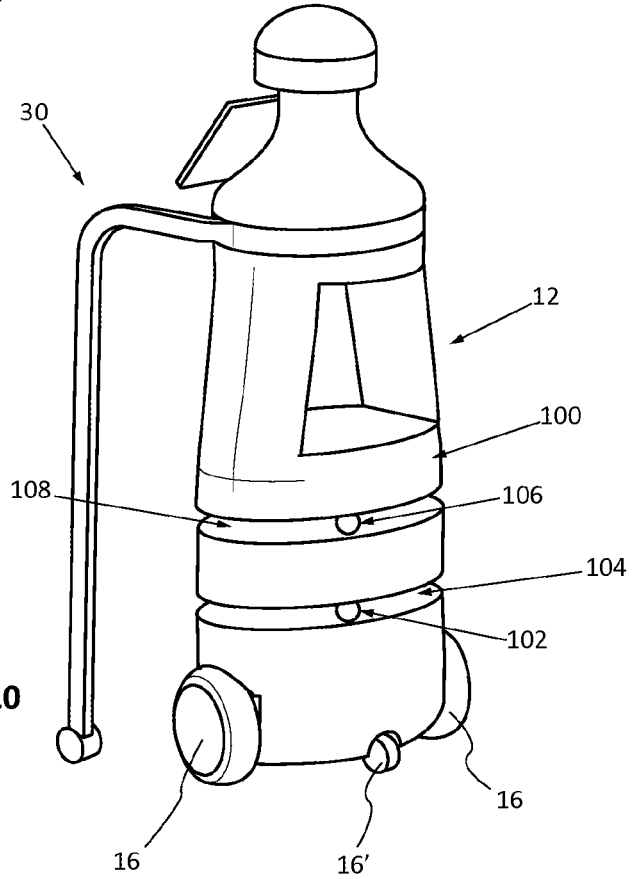

Other characteristics and advantages will emerge from the following description of the invention, a description given by way of example only, in relation to the accompanying drawings in which:

FIG. 1 is a side view of a robot equipped with a walking device that illustrates an embodiment of the invention, FIG. 2 is a view in perspective of the robot equipped with a walking device that is seen in FIG. 1, FIG. 3 is a view in perspective of the walking device that is seen in FIG. 1 that illustrates an embodiment of the invention, FIG. 4 is a view in perspective of a robot equipped with a walking device that illustrates another embodiment of the invention, FIGS. 5A and 5B are diagrams of a robot equipped with a walking device that illustrate the change from a sitting position to a standing position of an individual supported on the walking device, FIG. 6 is a top view of a robot equipped with a walking device and of an individual that illustrates a first configuration of paths followed by the robot and the individual, FIG. 7 is a top view of a robot equipped with a walking device and of an individual that illustrates a second configuration of paths followed by the robot and the individual, FIG. 8 is a top view of a robot equipped with a walking device and of an individual that illustrates a third configuration of paths followed by the robot and the individual, FIG. 9 is a first view in perspective of a robot equipped with a walking device that illustrates another embodiment of the invention, and FIG. 10 is a second view in perspective of the robot that is seen in FIG. 9.

In the various figures, a mobile robot has been represented as 10. This robot is specifically designed for the assistance of an individual.

This robot 10 comprises a mobile base 12.

According to an embodiment, the mobile base 12 is identical to the one described in the document WO-2008/149018. The mobile base 12 is not further described. Generally, this mobile base 12 makes it possible for the robot 10 to move autonomously in an environment, such as, for example, the inside of a residence or of a building.

Thus, the mobile base 12 comprises a base 100 that rests on at least three wheels 16, a control system 14 configured to control the characteristics (speed, path, . . . ) of the movement of the mobile base 12.

According to a preferred configuration, the mobile base 12 comprises two driving wheels 16 and at least one free wheel 16', the characteristics (speeds of rotation, directions of rotation) of the movement of rotation of the two driving wheels 16 being controlled by the control system 14.

According to a steering mode, the driving wheels 16 are configured to operate in differential mode. Thus, the mobile base 12 follows a curved path by imposing different speeds of rotation on the driving wheels 16. The mobile base 12 is configured to be able to pivot on itself about a pivot axis 18 that is perpendicular to the ground (consequently vertical if the ground is horizontal) and positioned in the middle of the two wheels.

According to an embodiment seen particularly in FIGS. 1 and 2, the mobile base 12 comprises four wheels, namely two driving side wheels 16, with axes perpendicular to a direction of advance and two free wheels 16' configured to pivot about a vertical axis, positioned in the front and in the rear according to the direction of advance relative to the side wheels 16.

According to another embodiment seen in FIGS. 9 and 10, the mobile base 12 comprises three wheels, namely two driving side wheels 16, with axes perpendicular to a direction of advance and one free wheel 16' configured to pivot about a vertical axis, positioned in the front according to the direction of advance relative to the side wheels 16. This configuration makes it possible to provide more space for the feet of the individual.

The mobile base 12 also comprises at least one surroundings sensor 102 configured to detect obstacles and to inform the control system 14 so that the latter modifies as appropriate the characteristics of the movement of the mobile base 12.

According to an embodiment, this surroundings sensor 102 is positioned in a first horizontal slot 104 made in the base 100 and that extends over at least a portion of the periphery of the base 100.

The robot is equipped with a walking device 20.

The robot 10 or the walking device 20 comprises a body 22 that is mobile in rotation relative to the mobile base 12 about an axis of rotation A22 that is parallel to the pivot axis 18 of the mobile base 12 and preferably aligned with said pivot axis 18.

According to an embodiment, the robot comprises a vertical column 24, a lower end of which is connected to the rolling base 12 and an upper end 26 of which supports the body 22.

According to a first variant, the walking device 20 is integral with the robot 10 and non-detachable, as illustrated in FIG. 4.

According to a second variant, the walking device 20 is connected to the robot 10 by a connecting system 28 that makes it possible to connect or separate the walking device 20 from the robot 10, as illustrated in FIGS. 2 and 3.

According to an embodiment seen in FIGS. 2 and 3, the body 22 is integral with the robot 10, and the connecting system 28 is provided between the body 22 and the walking device 20.

According to another embodiment, the body is integral with the walking device 20, and the connecting system 28 is provided between the body 22 and the column 24.

The walking device 20 comprises at least one bearing system 30 that can be gripped, connected to the body 22 and configured to support an individual. According to an embodiment, the bearing system 30 comprises at least one hand rail 32 in the form of a tube that exhibits, in a plane that is perpendicular to the axis of rotation A22, a U-shaped profile. Preferably, the U-shaped hand rail 32 comprises two arms 34, 34' that are parallel to the direction of advance, with ends 34E that are curved downward.

By bearing system that is able to be gripped is meant an element of the robot that an individual can grasp with at least one of his hands and on which the individual can exert a force with a constituent part directed toward the ground.

According to a characteristic of the invention, the walking device can comprise only a bearing system 30 configured to pivot freely relative to the mobile base 12 about a vertical axis of rotation A22. Thus, the individual can choose a path that is independent of that of the mobile base. Thus, the radius of curvature of the path C1 of the individual can be greater than that of the path C2 of the mobile base 12 as illustrated in FIG. 6, or the radius of curvature of the path C1 of the individual can be smaller than that of the path C2 of the mobile base 12 as illustrated in FIG. 7.

As illustrated in FIG. 8, insofar as the pivoting of the bearing system 30 is independent of that of the mobile base 12, the latter can pivot on itself without the individual having to move. Thus, it is possible to assist lateral movements of the individual.

According to an embodiment seen in FIGS. 2 and 3, the body 22 and the hand rail 32 have shapes that work together. According to an embodiment, the body 22 has the shape of a circular plate, and the U-shaped base 36 formed by the hand rail 32 describes an arc whose diameter is proportional to that of the plate. As illustrated in FIG. 2, the U-shaped base 36 has a diameter that is slightly greater than that of the plate so as to allow a space between the hand rail 32 and the body 22 to make possible the gripping of the hand rail 32 by an individual.

According to an embodiment, the walking device 20 comprises at least two connectors 38 that connect the hand rail 32 to the body 22. These connectors 38 are positioned around the body 22 and preferably are diametrically opposite. According to one configuration, a coupling system 28 is positioned between each connector 38 and the body 22.

According to a characteristic, the walking device 20 comprises, for each arm 34, 34' of the hand rail 32, a vertical leg 40, 40', positioned under the arm 34, 34', a lower end of which rests on the ground and an upper end of which is connected rigidly to the arm. The lower end of each leg 40, 40' comprises a free wheel 42, 42'.

As illustrated in FIGS. 5A and 5B, the legs 40, 40' ensure the bearing of the downward forces generated during the supporting of an individual on the walking device 20, particularly during a change of position (sitting/standing).

According to an embodiment, the bearing system 30 comprises two tubular frames 44, 44', each with two vertical posts positioned in the same vertical planes as the arms 34, 34' of the hand rail 32, for each of them one of the arms 34, 34' of the hand rail 32 forming the upper side of the frame 44, 44'. According to this embodiment, each leg 40, 40' is connected to the lower side 46, 46' of the corresponding tubular frame 44, 44'.

The walking device is configured so that the spacing between the free wheels 42, 42' of the legs 40, 40' is approximately equal to the spacing between the driving side wheels 16, 16' of the mobile base 12.

According to a configuration, when the robot 10 advances in a straight line, the arms 34, 34' and the legs 40, 40' are positioned in the same planes as the driving side wheels 16, 16' of the mobile base 12, the free wheels 42, 42' being positioned offset toward the back relative to the driving side wheels 16 of the mobile base 12.

According to a simplified variant, the bearing system 30 comprises two vertical posts positioned under each arm 34, 34'.

The vertical posts make it possible to offer several hand-grasping levels.

The walking device can comprise at least one cane holder 48, at least one basket 50 and/or at least one screen 52.

According to a characteristic of the invention, the walking device 20 comprises at least one control configured to transmit at least one signal to the control system 14 of the mobile base 12 so as to control the movements of the mobile base 12.

According to a first variant, the walking device 20 comprises at least one manual control that can be actuated directly by the individual.

According to this first variant, the walking device 20 comprises a first control 54, positioned on the right arm 34, configured to control a change of direction of the robot to the right and a second control 56, positioned on the left arm 34', configured to control a change of direction of the robot to the left. Optionally, the walking device 20 comprises a third control 58 configured to control a change of speed of the mobile base 12.

According to a second variant, the walking device 20 comprises at least one automatic control. According to this second variant, the robot comprises at least a first sensor 60 configured to detect at least one characteristic of a movement of rotation of the bearing system 30 relative to the mobile base 12 and to inform the control system 14 so that the latter modifies where appropriate the characteristics of the movement of the mobile base 12 as a function of the characteristic of the movement of rotation detected by the first sensor 60. According to an embodiment, this first sensor 60 is configured to detect the direction of rotation of the bearing system 30 relative to the base 12. Thus, the rotation of the bearing system 30 in a first direction causes a change of direction of the mobile base 12 to the right, and the rotation of the body 22 in a second direction causes a change of direction to the left.

According to another embodiment, in addition to the detection of the direction of rotation, the first sensor 60 is configured to determine an angle of rotation of the movement of rotation of the bearing system 30 relative to the mobile base 12, the turning radius of the mobile base 12 being inversely proportional to the angle of rotation of the bearing system 30 relative to the mobile base 12 as a function of the values measured by the second sensor 106.

According to an embodiment seen in FIGS. 9 and 10, the mobile base 12 comprises at least a second sensor 106 configured to detect a movement speed of an individual supported on the bearing system and to inform the control system 14 so that the latter modifies as appropriate the characteristics of the movement of the mobile base 12.

This second sensor 106 is configured to detect the movement of the legs of the individual, and it is positioned in an approximately horizontal second slot 108 made in the base 100 and positioned approximately at the height of the knees of an individual.

This second slot 108 can extend over the entire periphery of the base 100. The same applies to the first slot 104.

According to another characteristic, the walking device comprises a display device such as the screen 52 to display information pertaining to the movements of the robot, such as, for example, the direction of advance of the robot (forward/backward direction), the speed of the robot (slow/moderate/fast), a future change of direction (change of direction to the right/change of direction to the left) or the destination. This information pertaining to the movements of the robot can be communicated to the individual by means of audible messages.

According to the invention, the robot can operate in several modes.

According to a first mode referred to as manual, the individual supported on the walking device can control the changes of direction of the robot by causing the bearing system 30 to pivot around the axis of rotation A22. In addition, the robot comprises sensors configured to detect the speed, the direction and the direction of advance of the individual, and a control to control the speed, the direction and the direction of advance of the mobile base 12 from data detected by the sensors.

According to a second mode referred to as automatic, the mobile base 12 moves autonomously, and the pivoting of the bearing system 30 relative to the mobile base 12 has no influence on the path of the mobile base 12. In this case, the robot adapts its speed of advance to that of the individual supported on the walking device 20.

The robot equipped with the walking device can make it possible to have the individual supported on the walking device do physical exercises. Thus, a series of movements can be programmed and performed automatically by the mobile base 12.

The invention claimed is:

1. Mobile robot comprising:

a mobile base (12) that has a control system (14) configured to control the characteristics of the movement of the mobile base (12), and a bearing system (30) configured to be grasped by an individual, wherein the bearing system (30) is configured to pivot freely relative to the mobile base (12) about a vertical axis of rotation (A22) and wherein the robot comprises at least a first sensor (60) configured to detect at least one characteristic of a movement of rotation of the bearing system (30) relative to the mobile base (12) and to inform the control system (14) that is configured to modify the path of the robot as a function of the characteristic of the movement of rotation of the bearing system (30) that is detected by the first sensor (60).

2. Robot according to claim 1, wherein the axis of rotation (A22) of the bearing system is aligned with a pivot axis (18) on itself of the mobile base (12).

3. Robot according to claim 1, wherein the bearing system (30) comprises at least one hand rail (32) that comprises two arms (34, 34') parallel to the direction of advance of the mobile base (12).

4. Robot according to claim 3, further comprising for each arm (34, 34') a vertical leg (40, 40'), positioned under the arm (34, 34') and a lower end of which rests on the ground and an upper end of which is connected rigidly to the arm (34, 34').

5. Robot according to claim 4, wherein the lower end of each leg (40, 40') comprises a free wheel (42, 42').

6. Robot according to claim 1, further comprising at least a second sensor (106) configured to detect a movement speed of an individual supported on the bearing system (30) and to inform the control system (14) so that the latter modifies as appropriate the characteristics of the movement of the mobile base (12).

7. Robot according to claim 1, wherein the first sensor (60) is configured to detect the direction of rotation of the bearing system (30) relative to the base (12).

8. Robot according to claim 7, wherein the first sensor (60) is configured to determine an angle of rotation of the movement of rotation of the bearing system (30) relative to the mobile base (12).

9. Robot according to claim 1, wherein the bearing system (30) comprises two vertical posts.

10. Robot according to claim 1, further comprising a display device (52) to display information pertaining to the movements of the robot.

11. Robot according to claim 2, wherein the bearing system comprises at least one hand rail that comprises two arms parallel to the direction of advance of the mobile base.

12. Robot according to claim 2, further comprising at least a second sensor configured to detect a movement speed of an individual supported on the bearing system and to inform the control system so that the latter modifies as appropriate the characteristics of the movement of the mobile base.

13. Robot according to claim 3, further comprising at least a second sensor configured to detect a movement speed of an individual supported on the bearing system and to inform the control system so that the latter modifies as appropriate the characteristics of the movement of the mobile base.

14. Robot according to claim 4, further comprising at least a second sensor configured to detect a movement speed of an individual supported on the bearing system and to inform the control system so that the latter modifies as appropriate the characteristics of the movement of the mobile base.

15. Robot according to claim 5, further comprising at least a second sensor configured to detect a movement speed of an individual supported on the bearing system and to inform the control system so that the latter modifies as appropriate the characteristics of the movement of the mobile base.

16. Robot according to claim 2, wherein the first sensor is configured to detect the direction of rotation of the bearing system relative to the base.

17. Robot according to claim 3, wherein the first sensor is configured to detect the direction of rotation of the bearing system relative to the base.

18. Robot according to claim 4, wherein the first sensor is configured to detect the direction of rotation of the bearing system relative to the base.

19. Robot according to claim 5, wherein the first sensor is configured to detect the direction of rotation of the bearing system relative to the base.

20. Robot according to claim 6, wherein the first sensor is configured to detect the direction of rotation of the bearing system relative to the base.

* * * * *